US012551075B2

(12) United States Patent
Hong et al.

(10) Patent No.: US 12,551,075 B2
(45) Date of Patent: Feb. 17, 2026

(54) CLEANING ROBOT AND CONTROLLING METHOD THEREOF

(71) Applicant: SAMSUNG ELECTRONICS CO., LTD., Suwon-si (KR)

(72) Inventors: Jongsoo Hong, Suwon-si (KR); Jeehoon Kim, Suwon-si (KR); Chunseong Kim, Suwon-si (KR); Byoungwoo Ko, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 388 days.

(21) Appl. No.: 18/139,124

(22) Filed: Apr. 25, 2023

(65) Prior Publication Data

US 2023/0337882 A1 Oct. 26, 2023

Related U.S. Application Data

(63) Continuation of application No. PCT/KR2023/004988, filed on Apr. 13, 2023.

(30) Foreign Application Priority Data

Apr. 25, 2022 (KR) ..... 10-2022-0050993
Jul. 15, 2022 (KR) ..... 10-2022-0087846

(51) Int. Cl.
*A47L 11/40* (2006.01)
*A47L 9/28* (2006.01)
*A47L 11/283* (2006.01)

(52) U.S. Cl.
CPC ..... *A47L 11/4011* (2013.01); *A47L 9/2805* (2013.01); *A47L 11/283* (2013.01); *A47L 2201/022* (2013.01); *A47L 2201/04* (2013.01)

(58) Field of Classification Search
CPC ..... A47L 11/283; A47L 11/4011; A47L 9/06; A47L 11/4072
See application file for complete search history.

(56) References Cited

U.S. PATENT DOCUMENTS 5,424,939 A 6/1995 Kweon
5,613,261 A 3/1997 Kawakami et al.
(Continued)

FOREIGN PATENT DOCUMENTS

JP 10-201679 8/1998
JP 32993314 6/2002
(Continued)

OTHER PUBLICATIONS

International Search Report dated Jul. 26, 2023 issued in PCT Application No. PCT/KR2023/004988.
(Continued)

*Primary Examiner* — Michael D Jennings
(74) *Attorney, Agent, or Firm* — STAAS & HALSEY LLP

(57) ABSTRACT

A cleaning robot includes: a main body; a motion driver provided in the main body and configured to move the main body; a pad motor provided in the main body and configured to rotate a pad provided on a lower surface of the main body; a humidity sensor provided around the wet cloth pad and configured to detect humidity around the wet cloth pad; and at least one processor configured to control the pad motor to stop rotating the wet cloth pad and control the motion driver to return the cleaning robot to a docking station, in response to determining that current humidity detected by the humidity sensor becomes lower than preset reference humidity while the motion driver and the pad motor are operating.

15 Claims, 15 Drawing Sheets

(56) References Cited

U.S. PATENT DOCUMENTS

| | | | | |
|---|---|---|---|---|
| 6,191,476 | B1 | 2/2001 | Takahashi et al. | |
| 11,324,374 | B2 | 5/2022 | Jung et al. | |
| 2018/0000300 | A1* | 1/2018 | Yoon | A47L 9/04 |
| 2019/0328201 | A1* | 10/2019 | Shin | A47L 11/4069 |
| 2020/0000305 | A1* | 1/2020 | Fox | A47L 11/28 |
| 2020/0230806 | A1* | 7/2020 | Choi | B25J 9/0084 |
| 2021/0030234 | A1* | 2/2021 | Jang | A47L 11/4013 |
| 2021/0076893 | A1* | 3/2021 | Ahn | A47L 11/4072 |
| 2021/0093144 | A1* | 4/2021 | Shin | A47L 11/4061 |
| 2021/0318689 | A1* | 10/2021 | Miura | G05D 1/0274 |
| 2021/0330160 | A1* | 10/2021 | Sun | A47L 9/1683 |
| 2022/0047139 | A1* | 2/2022 | Jeong | A47L 11/4011 |
| 2022/0061616 | A1* | 3/2022 | Yoon | G01S 7/4813 |
| 2022/0079406 | A1 | 3/2022 | Zhang et al. | |
| 2022/0111408 | A1* | 4/2022 | Rieben | B08B 3/028 |
| 2022/0287532 | A1 | 9/2022 | Jang et al. | |
| 2022/0400925 | A1* | 12/2022 | Hoobler | A47L 11/28 |
| 2023/0255420 | A1* | 8/2023 | Mullinax | A47L 9/2873 15/259 |

FOREIGN PATENT DOCUMENTS

| | | |
|---|---|---|
| JP | 2003-299609 | 10/2003 |
| JP | 2014-100279 | 6/2014 |
| KR | 1994-0010289 | 10/1994 |
| KR | 1996-0014584 | 10/1996 |
| KR | 10-0688172 | 3/2007 |
| KR | 10-2010-0081448 | 7/2010 |
| KR | 10-2010-0112315 | 10/2010 |
| KR | 10-2013-0022636 | 3/2013 |
| KR | 10-1697557 | 1/2017 |
| KR | 20-2018-0002707 | 9/2018 |
| KR | 10-2020783 | 9/2019 |
| KR | 10-2054689 | 1/2020 |
| KR | 10-2021-0023649 | 3/2021 |
| WO | WO 2020/125491 A1 | 6/2020 |

OTHER PUBLICATIONS

Written Opinion dated Jul. 26, 2023 issued in PCT Application No. PCT/KR2023/004988.

* cited by examiner

CLEANING ROBOT AND CONTROLLING METHOD THEREOF

CROSS-REFERENCE TO RELATED APPLICATION(S)

This application is a continuation application of International Application No. PCT/KR2023/004988 filed on Apr. 13, 2023, and is based on and claims priority under 35 U.S.C. 119 to Korean Patent Application No. 10-2022-0050993, filed on Apr. 25, 2022 and Korean Patent Application No. 10-2022-0087846, filed on Jul. 15, 2022 in the Korean Intellectual Property Office, the disclosures of which are herein incorporated by reference in their entireties.

BACKGROUND

Field

The present disclosure relates to a cleaning robot including a wet cloth pad.

Description of the Related Arts

A cleaning robot is an apparatus for cleaning an area to be cleaned while autonomously traveling the area without a user's control. Recently, a cleaning robot capable of performing wet cleaning by providing a wet cloth pad on the lower surface has been developed.

Generally, a cleaning robot that performs wet cleaning provides a washing or replacement notification by simply calculating a travel distance and predicting contamination of a wet cloth pad according to an identification that the travel distance exceeds a preset distance.

Because contamination level prediction of a wet cloth pad based on a travel distance has low accuracy, cleaning may continue in the state in which wet cleaning ability deteriorates or in the state in which dirty substances are attached, which causes contamination of the floor or generates an unnecessary washing notification for a clean wet cloth pad.

SUMMARY

A cleaning robot according to an embodiment of the disclosure includes: a main body; a motion driver provided in the main body, and the motion driver configured to move the cleaning robot; a pad motor provided in the main body, the pad motor configured to rotate a pad provided on a lower surface of the main body; a humidity sensor provided around the pad and configured to detect humidity around the pad; and at least one processor configured to control an operation of the pad motor and an operation of the motion driver, while the motion driver and the pad motor are operating, the at least one processor is configured to stop rotating of the pad and control and operation of the motion driver to return the cleaning robot to a docking station, based on a current humidity, detected by the humidity sensor, being lower than preset reference humidity.

While the cleaning robot is returning to the docking station based on the detected current humidity being lower than the preset reference humidity, the at least one processor may control a user interface to guide washing or to guide a replacement of the pad for a user.

While the cleaning robot is returning to the docking station based on the detected current humidity being lower than the preset reference humidity, the at least one processor may control the pad to be spaced from a floor so that the pad does not contact the floor.

In response to the determining that the detected current humidity is changed at a preset change rate or more, the at least one processor may increase the reference humidity by a predetermined amount.

In response to determining that a number of times by which the detected current humidity changes at the preset change rate or more is a preset number of times or more, the at least one processor may increase the reference humidity by a predetermined amount.

In in response to determining that the detected current humidity is maintained at the preset change rate or more for a preset time, the at least one processor may increase the reference humidity by a predetermined amount.

The at least one processor may change the predetermined amount of the reference humidity according to a user's setting.

The at least one processor may control the pad motor to adjust a rotation speed of the pad based on the detected current humidity.

The at least one processor may control the pad motor to increase a rotation speed of the pad in proportion to a change rate of the detected current humidity according to information related to a traveling of the cleaning robot.

In response to determining that the detected current humidity changes at a preset change rate or more, the at least one processor may control the pad motor to change a rotation speed of the pad.

In response to determining that the detected current humidity changes at a preset change rate or more, the at least one processor may control to display a current location as an event occurrence zone on a cleaning map.

In response to determining that the detected current humidity changes at a preset change rate or more, the at least one processor may set a current location to a cleaning prohibited zone.

The at least one processor may adjust a radius of the cleaning prohibited zone according to a user's setting.

A method for controlling a cleaning robot including a main body, a motion driver provided in the main body and configured to move the cleaning robot, a pad rotatably provided on a lower surface of the main body, and a pad motor provided in the main body and configured to rotate the pad, includes: based on a current humidity around the pad, detected by a humidity sensor provided around the pad becomes lower than preset reference humidity while the motion driver and the pad motor are operating, controlling the pad motor to stop rotating of the pad; and controlling the motion driver to return the cleaning robot to a docking station.

The method may further include in response to determining that the detected current humidity changes at a preset change rate or more, increasing the reference humidity by a predetermined amount.

The increasing of the reference humidity by the predetermined amount may include increasing the reference humidity by the predetermined amount in response to determining that a number of times by which the current humidity detected by the humidity sensor changes at the preset change rate or more is a preset number of times or more.

The increasing of the reference humidity by the predetermined humidity may include increasing the reference humidity by the predetermined amount in response to determining that the current humidity detected by the humidity sensor is maintained at the preset change rate or more for a preset time.

The method may further include controlling the pad motor to adjust a rotation speed of the pad based on the current humidity detected by the humidity sensor.

The controlling of the pad motor may include controlling the pad motor to increase a rotation speed of the pad in proportion to a change rate of the current humidity detected by the humidity sensor according to traveling of the cleaning robot.

The method may further include controlling the pad motor to change a rotation speed of the pad in response to determining that the current humidity detected by the humidity sensor changes at a preset change rate or more.

DETAILED DESCRIPTION

Figure 1:
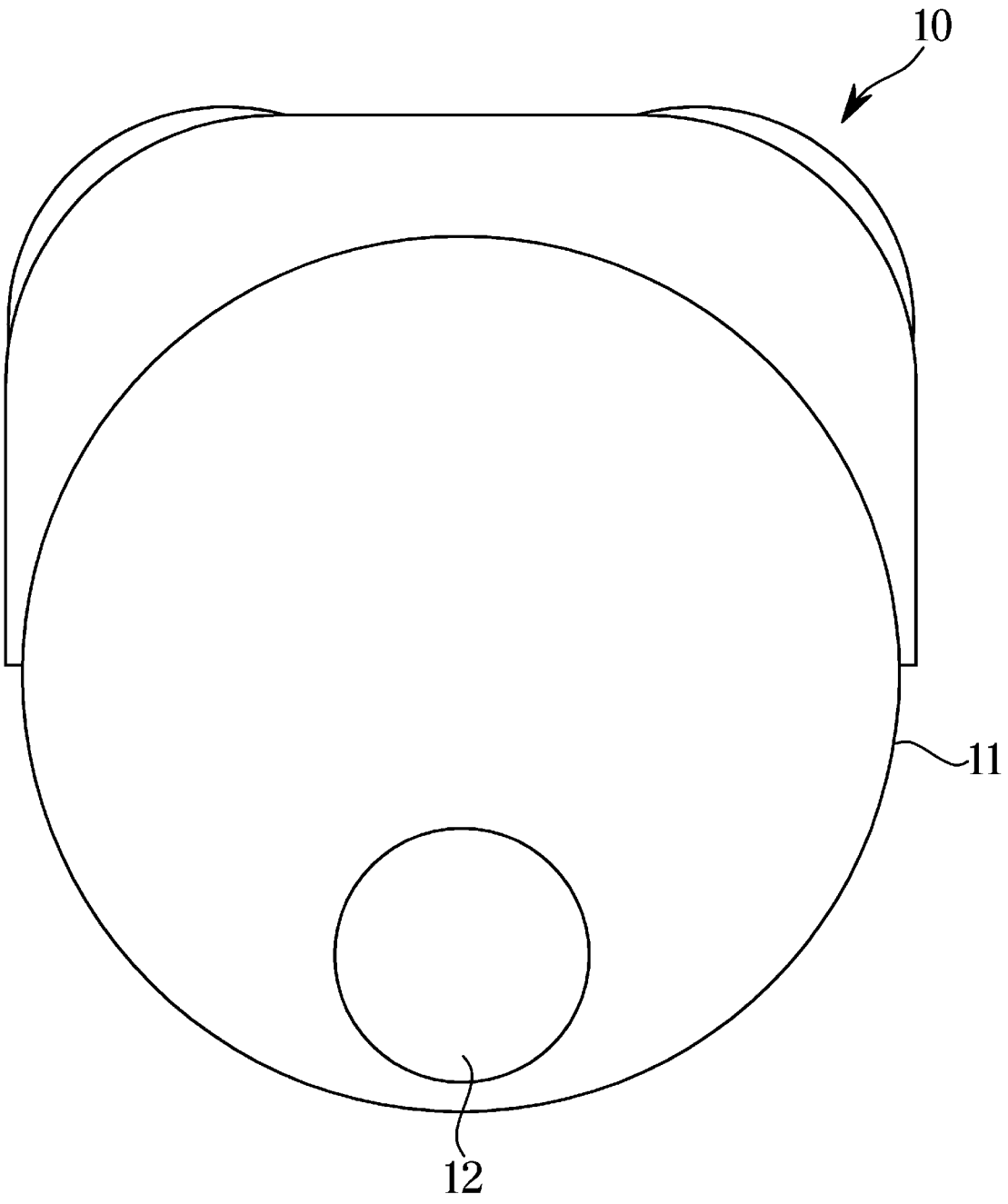
FIG. 1 is a top view of a cleaning robot according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Throughout this specification, it will be understood that when a certain part is referred to as being "connected" to another part, it can be directly or indirectly connected to the other part. When a part is indirectly connected to another part, it may be connected to the other part through a wireless communication network.

Also, the terms used in the present specification are merely used to describe the embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

It will be understood that, although the terms "first", "second", etc., may be used herein to describe various components, these components should not be limited by these terms. The above terms are used only to distinguish one component from another. For example, a first component discussed below could be termed a second component, and similarly, a second component may be termed a first component without departing from the scope of right of the disclosure.

In addition, the terms "portion", "device", "block", "member", and "module" used herein refer to a unit for processing at least one function or operation. For example, the terms may mean at least one process that may be processed by at least one hardware such as field-programmable gate array (FPGA) or application specific integrated circuit (ASIC), or at least one software or processor stored in a memory.

Reference numerals used in operations are provided to identify the operations, without describing the order of the operations, and the operations can be executed in a different order from the stated order unless a specific order is definitely specified in the context.

Hereinafter, embodiments of the disclosure will be described in detail with reference to the accompanying drawings.

The disclosure provides a cleaning robot for controlling a cleaning strength or returning to a docking station to wash a wet cloth pad by using a humidity sensor module provided around the wet cloth pad to detect humidity, and a method for controlling the cleaning robot.

A cleaning robot and a control method thereof according to an embodiment of the disclosure may control a cleaning strength or return to a docking station to wash a wet cloth pad by using a humidity sensor module provided around the wet cloth pad to detect humidity, thereby raising efficiency of wet cleaning.

Figure 2:
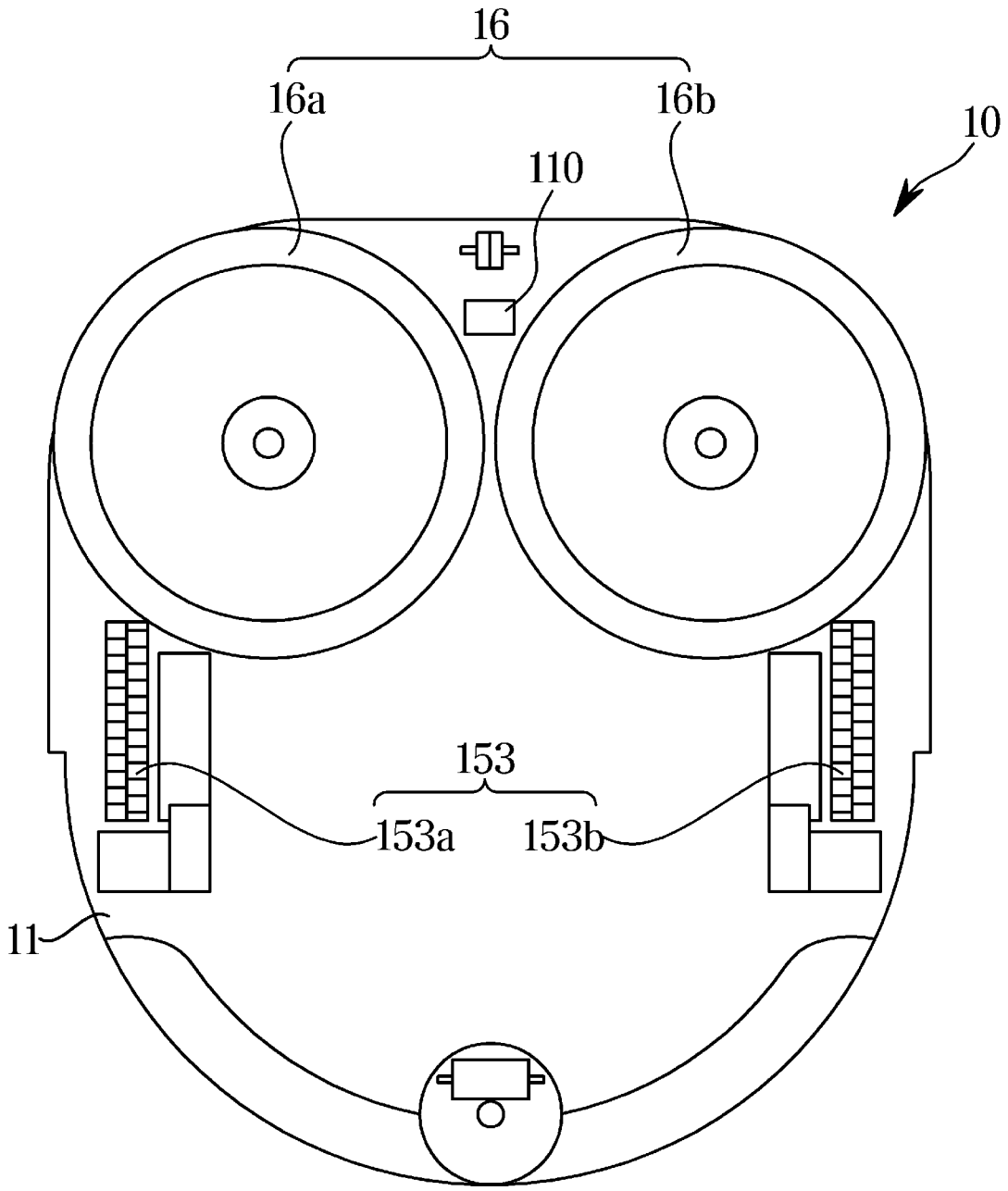
FIG. 2 is a bottom view of a cleaning robot according to an embodiment of the disclosure.
Figure 3:
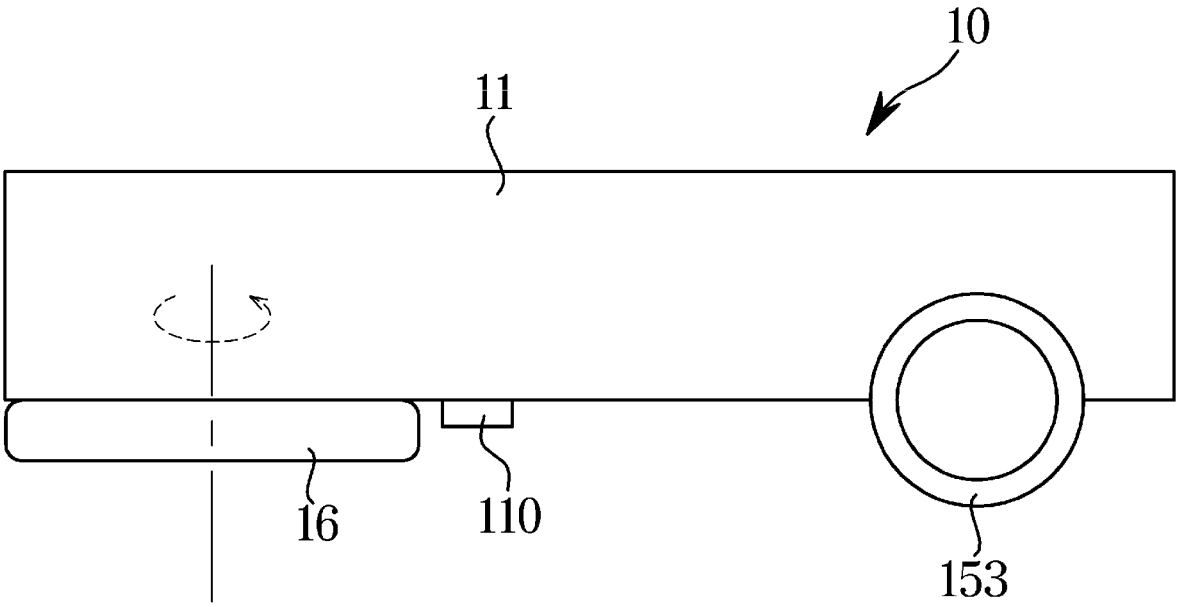
FIG. 3 is a schematic side view of a cleaning robot according to an embodiment of the disclosure.

FIG. 1 is a top view of a cleaning robot according to an embodiment of the disclosure, FIG. 2 is a bottom view of a cleaning robot according to an embodiment of the disclosure, and FIG. 3 is a schematic side view of a cleaning robot according to an embodiment of the disclosure.

Referring to FIGS. 1 to 3, a cleaning robot 10 according to an embodiment of the disclosure may include a main body 11 forming an appearance, a traveling wheel 153 (153*a* and 153*b*) for moving the main body 11, and a detection sensor 12 for detecting a surrounding object. For example, the detection sensor 12 may include a radar sensor. However, a type of a sensor included in the detection sensor 12 is not limited to a radar sensor, and the type of the sensor is not limited as long as the detection sensor 12 is capable of detecting a surrounding object.

The cleaning robot 10 may detect a surrounding object through the detection sensor 12, and perform cleaning while traveling an area to be cleaned by controlling the traveling wheel 153 to travel autonomously based on information about the detected surrounding object.

Particularly, the cleaning robot 10 may include at least one pad 16 (16*a* and 16*b*) rotatably provided on a lower surface of the main body 11, as shown in FIGS. 2 and 3, and the cleaning robot 10 may clean a floor by rotating the at least one pad 16 while traveling an area to be cleaned through autonomous driving. In FIG. 2, two pads 16 are shown, however, a number of the pads 16 provided on the lower surface of the cleaning robot 10 is not limited. At least one pad 16 may comprises a material that can absorb water (e.g. cloth, sponge, etc). Thus, hereinafter the pad 16 is defined as the wet cloth pad 16 for intuitiveness of meaning, however, it should be understood that the wet cloth pad 16 may be made of other materials other than the cloth.

The wet cloth pad 16 may receive water from a docking station (not shown) or a water supply device (not shown) provided in the cleaning robot 10.

In this case, a water content of the wet cloth pad 16 may decrease while the cleaning robot 10 travels to perform cleaning, and a decrease rate of the water content may depend on a contamination level of a floor of an area to be cleaned.

That is, a water content of the wet cloth pad 16 may decrease as a contamination level of the wet cloth pad 16 increases according to progress of cleaning, and accordingly, replacement or washing of the wet cloth pad 16 may be needed.

As such, a water content of the wet cloth pad 16 may represent a contamination level of the wet cloth pad 16, and a change amount of the water content may reflect a contamination level of a floor. Based on this, the cleaning robot 10 according to the disclosure may raise efficiency of wet cleaning by identifying a water content of the wet cloth pad 16 and using the water content for a control.

More specifically, the cleaning robot 10 may include, as shown in FIGS. 2 and 3, a humidity sensor module 110 provided around the wet cloth pad 16 to detect ambient humidity around the wet cloth pad 16.

As such, the humidity sensor module 110 may be positioned around the wet cloth pad 16 to detect ambient humidity around the wet cloth pad 16, wherein output humidity from the humidity sensor module 110 may be proportional to a water content of the wet cloth pad 16. That is, output humidity from the humidity sensor module 110 may reflect a water content of the wet cloth pad 16, and the cleaning robot 10 may store information about correlation between output humidity from the humidity sensor module 110 and a water content of the wet cloth pad 16.

Accordingly, the cleaning robot 10 may identity whether wet cleaning is possible by predicting a water content of the wet cloth pad 16 based on output humidity from the humidity sensor module 110.

So far, the appearance of the cleaning robot 10 and components exposed to the appearance have been described. Hereinafter, an operation in which the cleaning robot 10 controls a cleaning strength or identifies cleaning interruption and a return to the docking station based on output humidity from the humidity sensor module 110 will be described.

Figure 4:
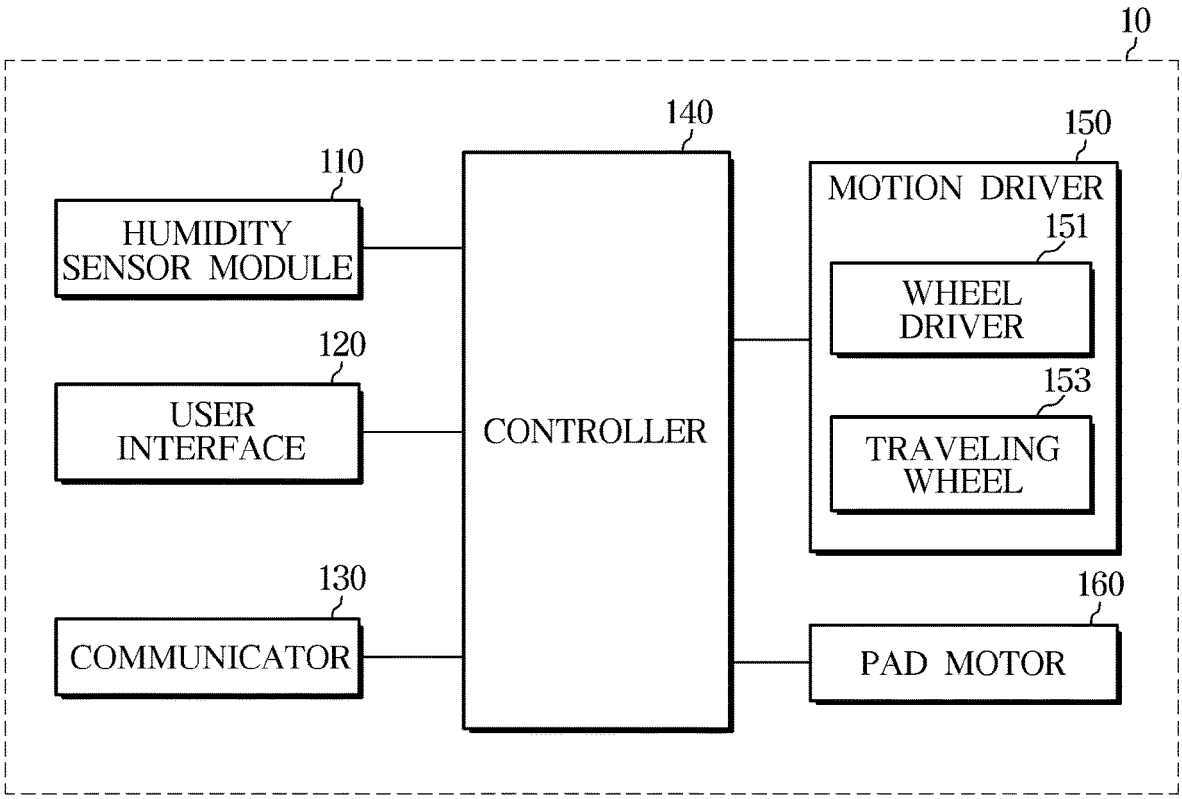
FIG. 4 is a control block diagram of a cleaning robot according to an embodiment of the disclosure.

FIG. 4 is a control block diagram of the cleaning robot 10 according to an embodiment of the disclosure.

Referring to FIG. 4, the cleaning robot 10 according to an embodiment of the disclosure may include the humidity sensor module 110 provided around the wet cloth pad 16 to detect ambient humidity around the wet cloth pad 16, a user interface 120 for receiving an input from a user or displaying information, a communicator 130 for performing communication with a user terminal, a controller 140 for controlling a cleaning strength or controlling cleaning interruption and a return to the docking station based on output humidity from the humidity sensor module 110, a motion driver 150 for moving the main body 11, and a pad motor 160 for rotating the wet cloth pad 16.

However, components of the cleaning robot 10, as shown in FIG. 4, are an example, and according to some embodiments of the disclosure, some of the components shown in FIG. 4 may be omitted or another component not shown may be added.

The humidity sensor module 110 according to an embodiment of the disclosure may include a humidity sensor including a signal processing circuit for measuring a water content change in air and changing the water content change to an electrical signal, an analog to digital (A/D) converter for digitalizing an electrical signal, a memory storing a digitalized electrical signal, and a digital signal processor for processing a signal stored in the memory by interpreting and analyzing the signal.

According to some embodiments of the disclosure, the humidity sensor module 110 may be provided around the wet cloth pad 16 to detect ambient humidity around the wet cloth pad 16. Therefore, output humidity from the humidity sensor module 110 may be proportional to a water content of the wet cloth pad 16. The output humidity from the humidity sensor module 110 may refer to a current humidity detected by the humidity sensor module 110. Information and/or data related with a current humidity detected by the humidity sensor module 110 may be transmitted to the controller 140.

The user interface 120 according to an embodiment of the disclosure may be provided at one side of the main body 11 to receive a user input or display information. For this, the user interface 120 may be provided as a known type of input device, a known type of display panel, or a component into which a touch panel and a display panel are integrated.

For example, the user interface 120 may receive a user input for adjusting a control strength according to a rapid change of output humidity from the humidity sensor module 110, or a user input for adjusting a radius of a cleaning prohibited zone.

Also, the user interface 120 may display a cleaning map corresponding to an area to be cleaned, and according to a rapid change of output humidity from the humidity sensor module 100, the user interface 120 may display a current location as an event occurrence zone on the cleaning map.

The communicator 130 according to an embodiment of the disclosure may perform wireless communication with a user terminal of a user who uses the cleaning robot 10. For this, the communicator 130 may be provided as a known type of wireless communication module.

For example, the communicator 130 may receive a user input for adjusting a control strength according to a rapid change of output humidity from the humidity sensor module 110 from the user terminal, or the communicator 130 may receive a user input for adjusting a radius of a cleaning prohibited zone from the user terminal.

Also, the communicator 130 may transmit a cleaning map corresponding to an area to be cleaned, or a control command for displaying a current location as an event occurrence zone according to a rapid change of output humidity from the humidity sensor module 110 to the user terminal.

In a case in which output humidity from the humidity sensor module 110 becomes lower than preset reference humidity while the main body 11 moves and the wet cloth pad 16 rotates, the controller 140 according to an embodiment of the disclosure may control the pad motor 160 to stop rotating the wet cloth pad 16 and control the motion driver 150 to return to the docking station.

In this case, the reference humidity may be ambient humidity around the wet cloth pad 16, corresponding to a water content of the wet cloth pad 16, which is too low to perform cleaning. The reference humidity may be a preset value, and according to some embodiments of the disclosure, the reference humidity may be a value that is to be adjusted based on a user input received through the user interface 120 or the communicator 130.

That is, in a case in which output humidity from the humidity sensor module 110 is a value representing cleaning ability degradation of the wet cloth pad 16, the controller 140 may interrupt a cleaning operation and return to the docking station to initialize the wet cloth pad 16, thereby raising efficiency of wet cleaning. In other words, the controller 140 may prevent a situation in which the floor may be contaminated due to cleaning by a rotation of the wet cloth pad 16 contaminated in a state of cleaning ability degradation.

According to some embodiments of the disclosure, upon docking of the main body 11 at the docking station, the controller 140 may control the communicator 130 to transmit a washing command or a replacement command for the wet cloth pad 16 to the docking station.

While the controller 140 according to an embodiment of the disclosure controls the motion driver 150 to return to the docking station, the controller 140 may guide washing or replacement of the wet cloth pad 16 for a user. For example, the controller 140 may control the user interface 120 to guide washing or replacement of the wet cloth pad 16 for a user, or control the communicator 130 to transmit a guide message to the user terminal.

While the controller 140 according to an embodiment of the disclosure controls the motion driver 150 to return to the docking station, the controller 140 may control the wet cloth pad 16 to be spaced from the floor. For example, the controller 140 may control an actuator (not shown) physically connected to the wet cloth pad 16 to move the wet cloth pad 16 in a reverse direction of gravity, or may control an actuator (not shown) connected to the traveling wheel 153 to move the main body 11 in the reverse direction of gravity.

In a case in which output humidity from the humidity sensor module 110 changes at a preset change rate or more, the controller 140 according to an embodiment of the disclosure may control the motion driver 150 to immediately return to the docking station.

Also, in the case in which output humidity from the humidity sensor module 110 changes at the preset change rate or more, the controller 140 according to an embodiment of the disclosure may adjust reference humidity corresponding to a threshold value of cleaning ability degradation for a quick return to the docking station. That is, in the case in which the output humidity from the humidity sensor module 110 changes at the preset change rate or more, the controller 140 may adjust the reference humidity to higher humidity.

According to some embodiments of the disclosure, the controller 140 may adjust the reference humidity to higher humidity in a case in which a number of times by which output humidity from the humidity sensor module 110 changes at the preset change rate or more is a preset number of times or more.

Also, according to some embodiments of the disclosure, the controller 140 may adjust the reference humidity to higher humidity in a case in which output humidity from the humidity sensor module 110 is maintained at the preset change rate or more for a preset time.

At this time, according to some embodiments of the disclosure, the controller 140 may change an adjustment amount of the reference humidity according to a user's setting. That is, the user may adjust control sensitivity for a case in which ambient humidity around the wet cloth pad 16 changes rapidly through the user interface 120 or the user terminal.

The controller 140 according to an embodiment of the disclosure may control the pad motor 160 to adjust a rotation speed of the wet cloth pad 16 based on output humidity from the humidity sensor module 110.

According to embodiments of the disclosure, the controller 140 may control the pad motor 160 to increase a rotation speed of the wet cloth pad 16 in proportion to a change rate of output humidity from the humidity sensor module 110 according to traveling.

In the case in which output humidity from the humidity sensor module 110 changes at the preset change rate or more, the controller 140 according to an embodiment of the disclosure may control the pad motor 160 to change a rotation speed of the wet cloth pad 16. For example, the controller 140 may control the pad motor 160 to raise a rotation speed of the wet cloth pad 16.

In the case in which output humidity from the humidity sensor module 110 changes at the preset change rate or more, the controller 140 according to an embodiment of the disclosure may perform a control of displaying a current location as an event occurrence zone on a cleaning map. For example, the controller 140 may control the user interface 120 to display the current location as the event occurrence zone on the cleaning map. Also, the controller 140 may control the communicator 130 to transmit a control command for displaying the current location as the event occurrence zone on the cleaning map to the user terminal.

In the case in which output humidity from the humidity sensor module 110 changes at the preset change rate or more, the controller 140 according to an embodiment of the disclosure may set a current location to a cleaning prohibited zone. At this time, according to some embodiments of the disclosure, the controller 140 may adjust a radius of the cleaning prohibited zone according to a user's setting. For example, the controller 140 may adjust a radius of the cleaning prohibited zone based on a user input received from the user interface 120 or input by the user terminal and received through the communicator 130.

The controller 140 may include at least one memory storing a program for performing the above-described operations and operations which will be described below and at least one processor for executing the stored program. A plurality of memories and a plurality of processors may be provided. In this case, the plurality of memories and the plurality of processors may be integrated into a single chip or provided at physically separated locations.

The motion driver 150 according to an embodiment of the disclosure may include a plurality of traveling wheels 153 respectively provided at left and right portions of the main body 11, and a wheel driver 151 for providing power to the traveling wheels 153. The wheel driver 151 may include a wheel motor and a driving circuit.

The pad motor 160 according to an embodiment of the disclosure may rotate the wet cloth pad 16, and change a rotation speed based on a control by the controller 140 to change a rotation speed of the wet cloth pad 16.

So far, control components for the cleaning robot 10 have been described. Hereinafter, an operation in which the cleaning robot 10 performs a control based on output humidity from the humidity sensor module 110 by using the control components will be described in detail.

Figure 5:
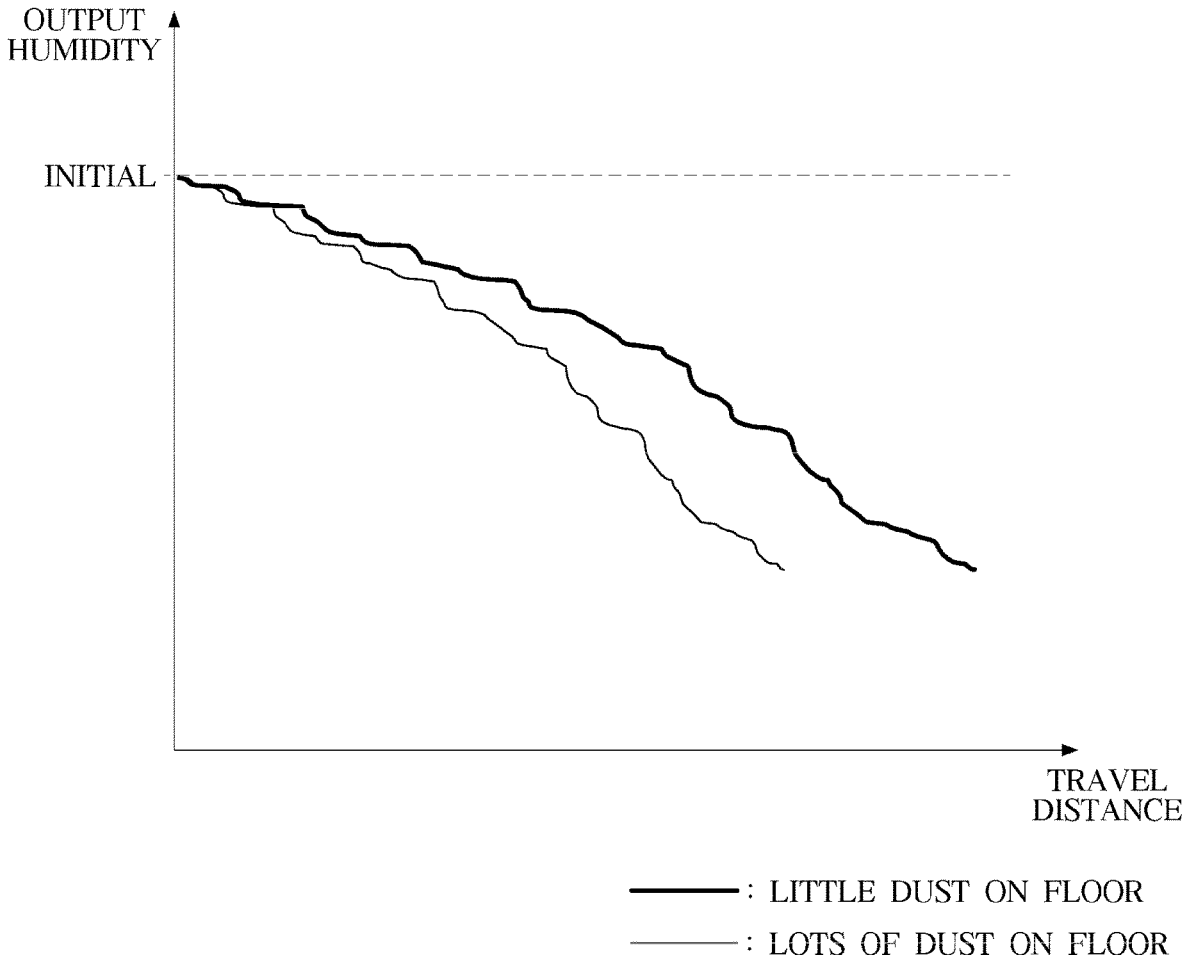
FIG. 5 is a view for describing output humidity from a humidity sensor module according to traveling of a cleaning robot according to an embodiment of the disclosure.

FIG. 5 is a view for describing output humidity from the humidity sensor module 110 according to traveling of the cleaning robot 10 according to an embodiment of the disclosure.

Referring to FIG. 5, while the cleaning robot 10 according to an embodiment of the disclosure travels to perform cleaning, a contamination level of the wet cloth pad 16 may increase, a water content of the wet cloth pad 16 may decrease, and output humidity from the humidity sensor module 110 for detecting ambient humidity around the wet cloth pad 16 may decrease.

Also, at a higher contamination level of a floor that is cleaned by the cleaning robot 10, a contamination level of the wet cloth pad 16 may further increase, which further decreases a water content of the wet cloth pad 16, and output humidity from the humidity sensor module 110 for detecting ambient humidity around the wet cloth pad 16 may also further decrease.

Based on a fact that, as the wet cloth pad 16 is more contaminated, a water content of the wet cloth pad 16 decreases and accordingly output humidity from the humidity sensor module 110 for detecting ambient humidity around the wet cloth pad 16 decreases, the cleaning robot 10 according to the disclosure may control a cleaning strength or identify cleaning interruption and a return to the docking station based on output humidity from the humidity sensor module 110.

Hereinafter, an embodiment in which the cleaning robot 10 controls cleaning interruption and a return to the docking station based on output humidity from the humidity sensor module 110 will be described in more detail.

Figure 6:
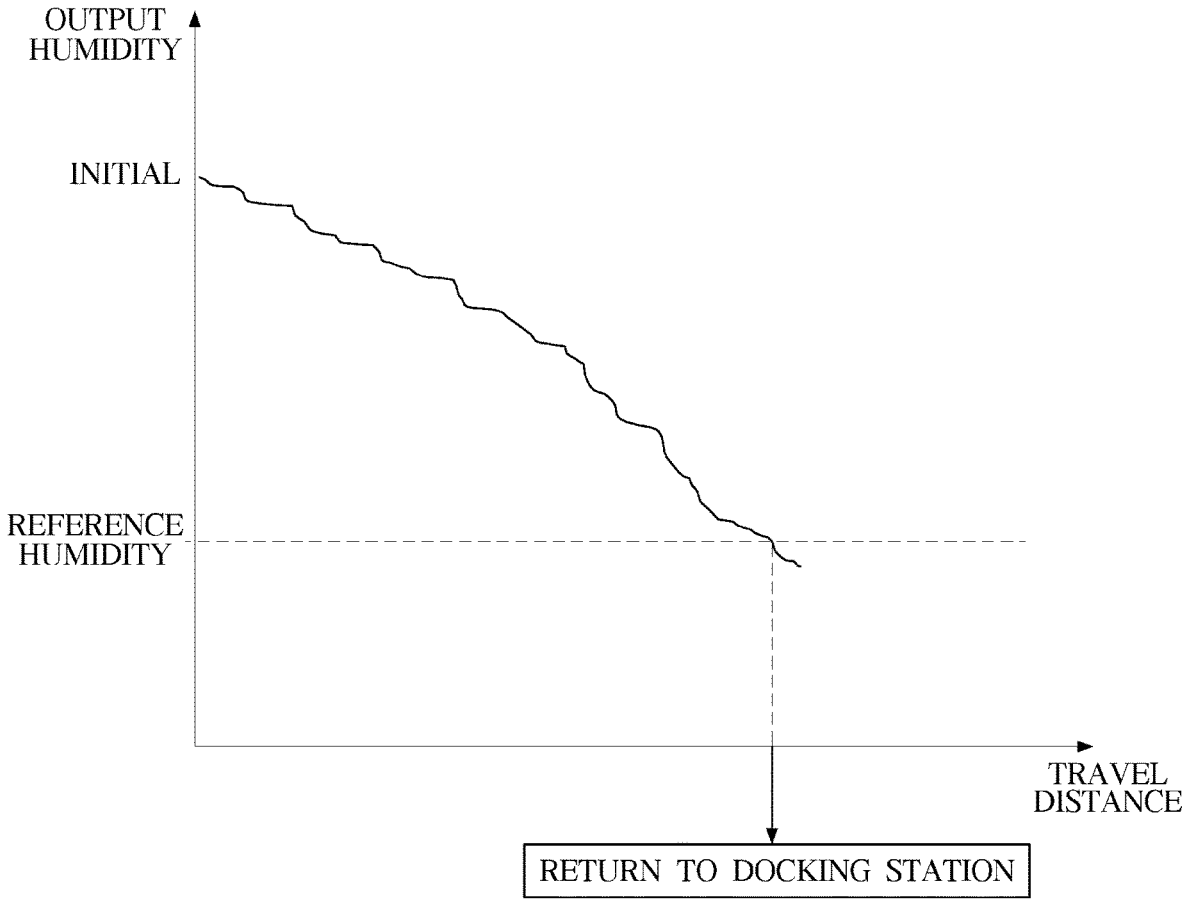
FIG. 6 is a view for describing a case in which a cleaning robot according to an embodiment of the disclosure returns to a docking station based on output humidity from a humidity sensor module.
Figure 7:
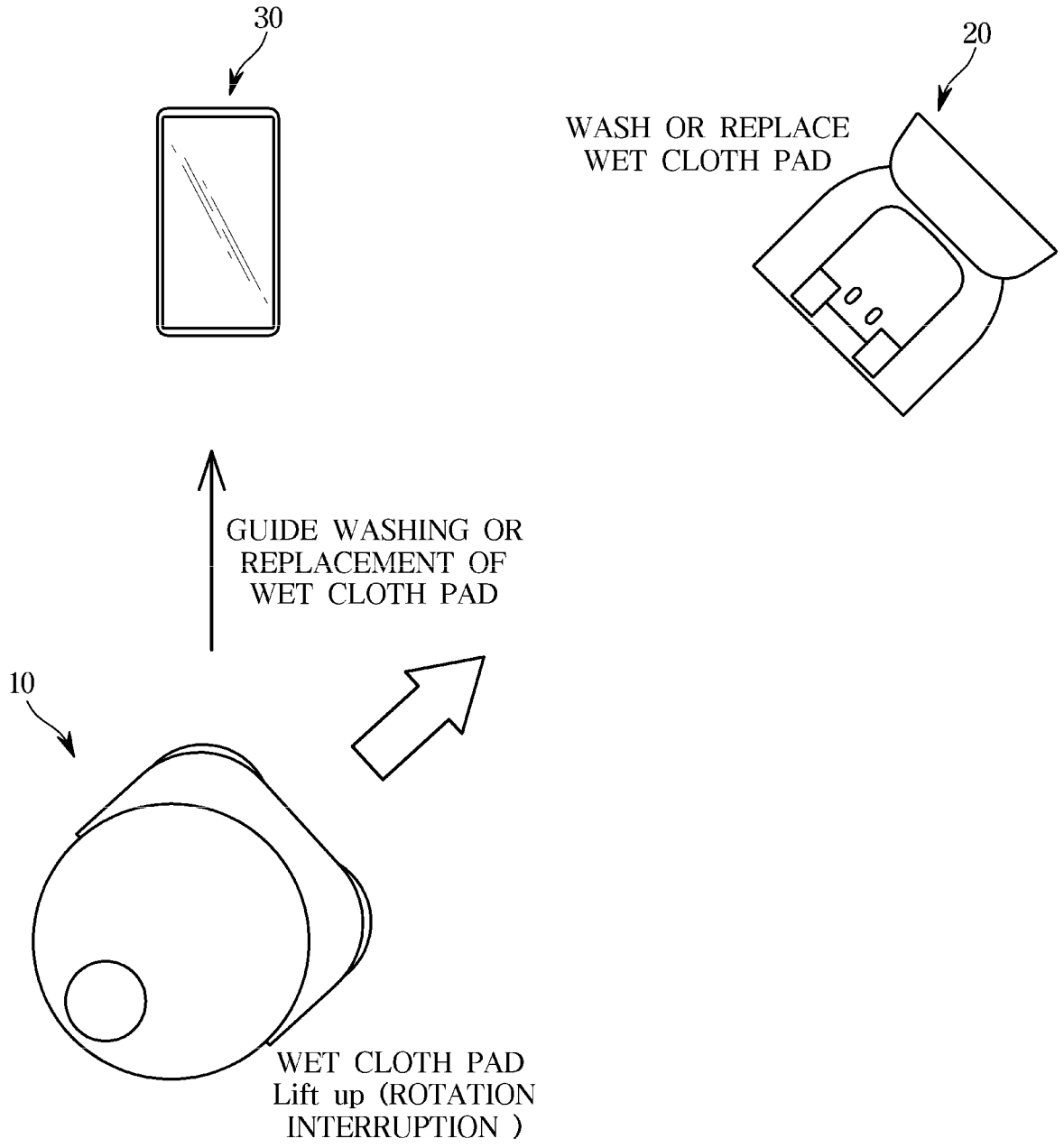
FIG. 7 is a view for describing an operation of a case in which a cleaning robot according to an embodiment of the disclosure returns to a docking station.
Figure 8:
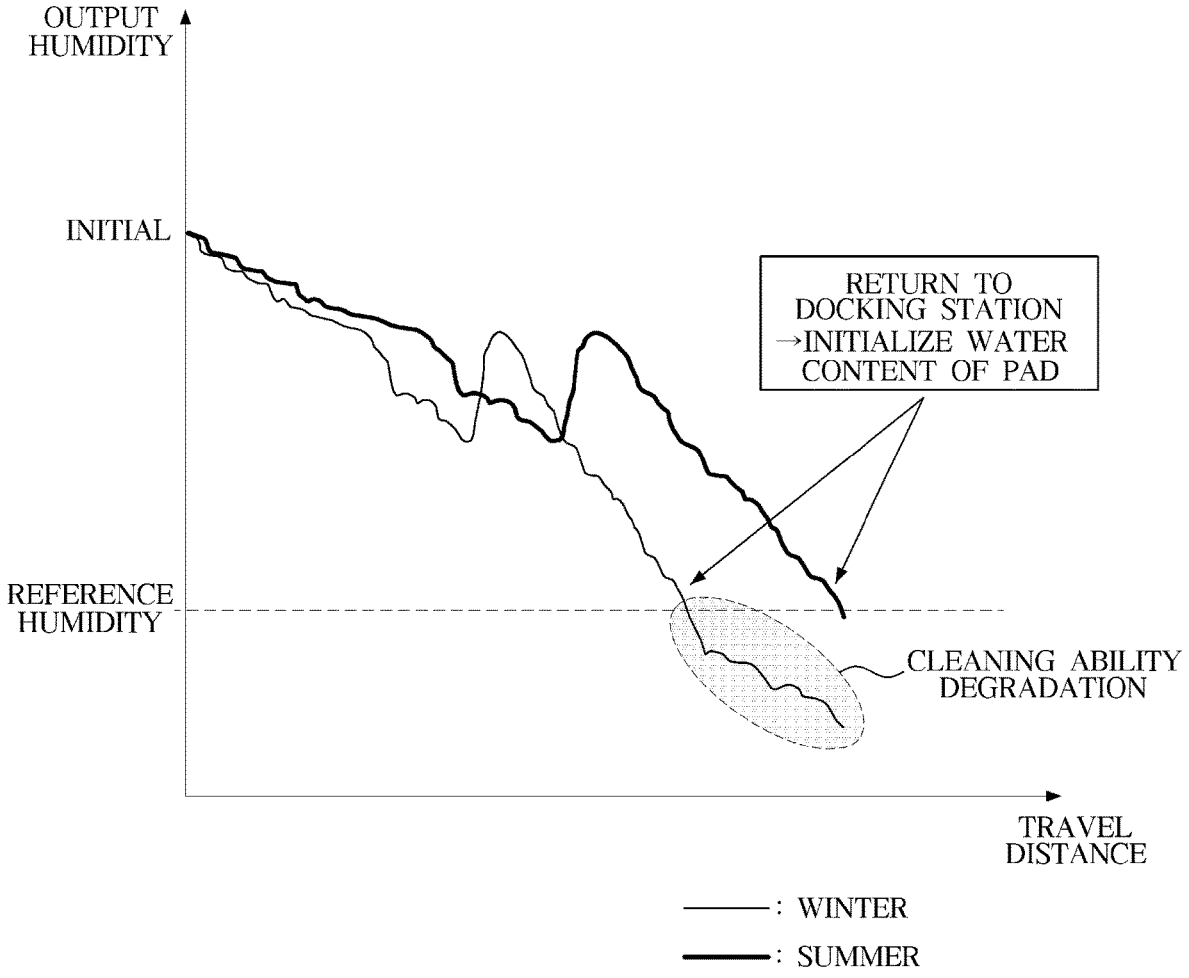
FIG. 8 is a view for describing an operation in which a cleaning robot according to an embodiment of the disclosure returns to a docking station to maintain cleaning ability regardless of seasons.

FIG. 6 is a view for describing a case in which the cleaning robot 10 according to an embodiment of the disclosure returns to the docking station based on output humidity from the humidity sensor module 110, FIG. 7 is a view for describing an operation of a case in which the cleaning robot 10 according to an embodiment of the disclosure returns to the docking station, and FIG. 8 is a view for describing an operation in which the cleaning robot 10 according to an embodiment of the disclosure returns to the docking station to maintain cleaning ability regardless of seasons.

Referring to FIGS. 6 and 7, in a case in which output humidity from the humidity sensor module 110 becomes lower than preset reference humidity while the main body 11 moves and the wet cloth pad 16 rotates, the cleaning robot 10 according to an embodiment of the disclosure may control the pad motor 160 to stop rotating the wet cloth pad 16 and control the motion driver 150 to return to the docking station.

In this case, the reference humidity may be ambient humidity around the wet cloth pad 16, corresponding to a water content of the wet cloth pad 16, which is too low to perform cleaning. The reference humidity may be a preset value, and according to some embodiments of the disclosure, the reference humidity may be a value that is to be adjusted based on a user input received through the user interface 120 or the communicator 130.

That is, the cleaning robot 10 may identify a return to a docking station 20 by comparing output humidity from the humidity sensor module 110 with the reference humidity corresponding to a threshold value of cleaning ability degradation, thereby preventing a case in which the floor is contaminated while the wet cloth pad 16 performs cleaning, guiding replacement or washing of the wet cloth pad 16 for a user, or causing the wet cloth pad 16 to be automatically replaced or washed in the docking station 20.

While the cleaning robot 10 according to an embodiment of the disclosure controls the motion driver 150 to return to the docking station 20, as shown in FIG. 7, the cleaning robot 10 may guide washing or replacement of the wet cloth pad 16 for the user. For example, the cleaning robot 10 may control the user interface 120 to guide washing or replacement of the wet cloth pad 16 for the user, or control the communicator 130 to transmit a guide message to a user terminal 30.

While the cleaning robot 10 according to an embodiment of the disclosure controls the motion driver 150 to return to the docking station 20, as shown in FIG. 7, the cleaning robot 10 may control the pad motor 160 to stop rotating the wet cloth pad 16, thereby preventing a situation in which the floor may be contaminated due to cleaning by a rotation of the wet cloth pad 16 contaminated in a state of cleaning ability degradation.

While the cleaning robot 10 according to an embodiment of the disclosure controls the motion driver 150 to return to the docking station 20, as shown in FIG. 7, the cleaning robot 10 may control the wet cloth pad 16 to be spaced from the floor. For example, the cleaning robot 10 may control an actuator (not shown) physically connected to the wet cloth pad 16 to move the wet cloth pad 16 in the reverse direction of gravity, or the cleaning robot 10 may control an actuator (not shown) connected to the traveling wheel 153 to move the main body 11 in the reverse direction of gravity.

Also, after the cleaning robot 10 is docked at the docking station 20, the docking station 20 may charge a battery of the cleaning robot 10 and automatically replace or wash the wet cloth pad 16 of the cleaning robot 10. The wet cloth pad 16 may be washed such that a water content of the wet cloth pad 16 increases up to a level capable of performing cleaning.

As such, the cleaning robot 10 according to an embodiment of the disclosure may identify cleaning interruption and a return to the docking station 20 by comparing output humidity from the humidity sensor module 110 with the reference humidity corresponding to the threshold value of cleaning ability degradation, thereby maintaining constant cleaning ability regardless of indoor humidity.

More specifically, as shown in FIG. 8, because water of the wet cloth pad 16 evaporates more quickly in the winter season than in the summer season, a decrease rate of output humidity from the humidity sensor module 110 in the winter season according to a travel distance may be greater than a decrease rate of output humidity from the humidity sensor module 110 in the summer season according to a travel distance.

The cleaning robot 10 according to the disclosure may prevent a phenomenon in which an absolute value of a water content of the wet cloth pad 16 decreases to degrade cleaning ability, regardless of seasons, by applying the same value of reference humidity regardless of seasons.

Figure 9:
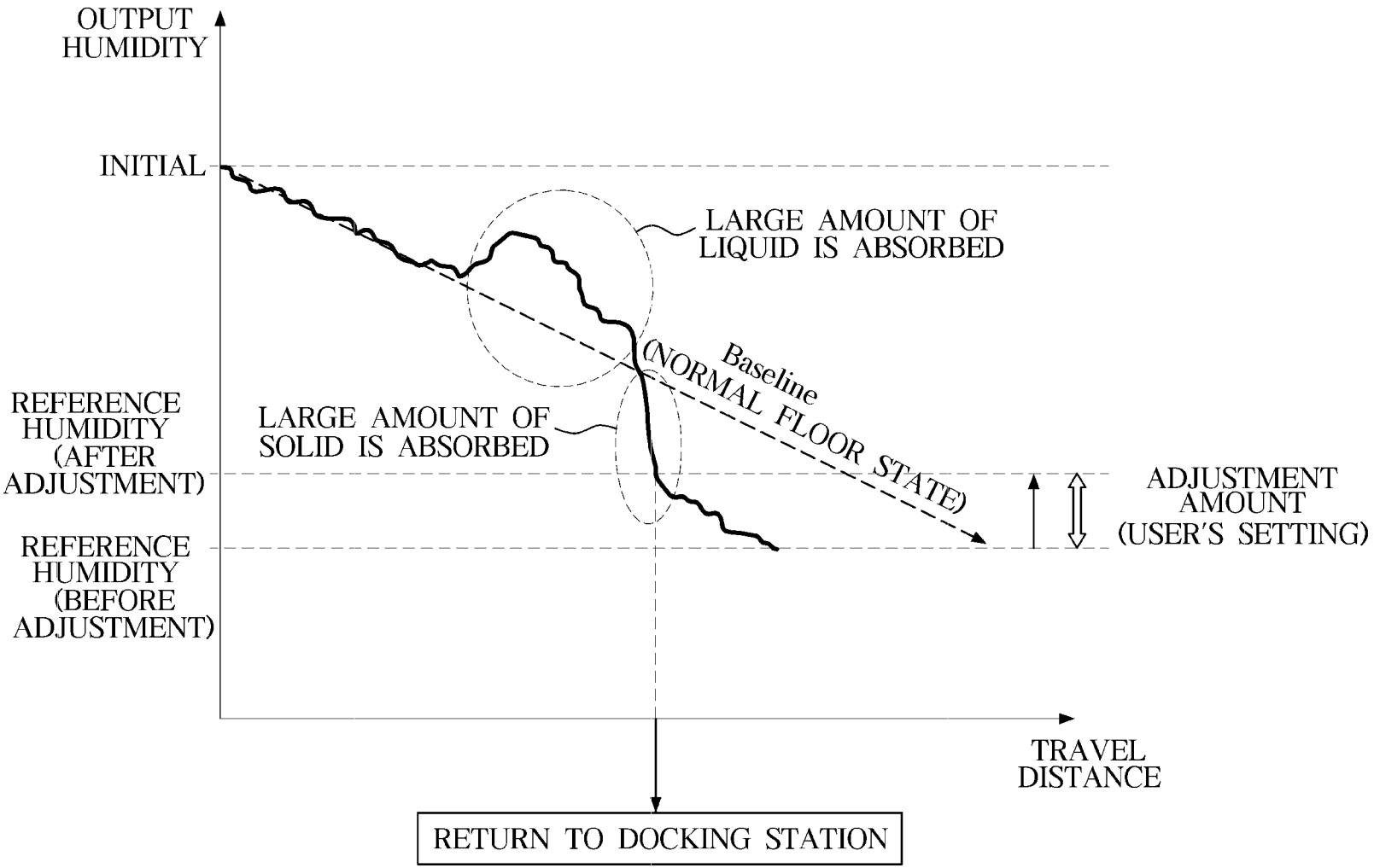
FIGS. 9 and 10 are views for describing a case in which a cleaning robot according to an embodiment of the disclosure adjusts reference humidity.
Figure 10:
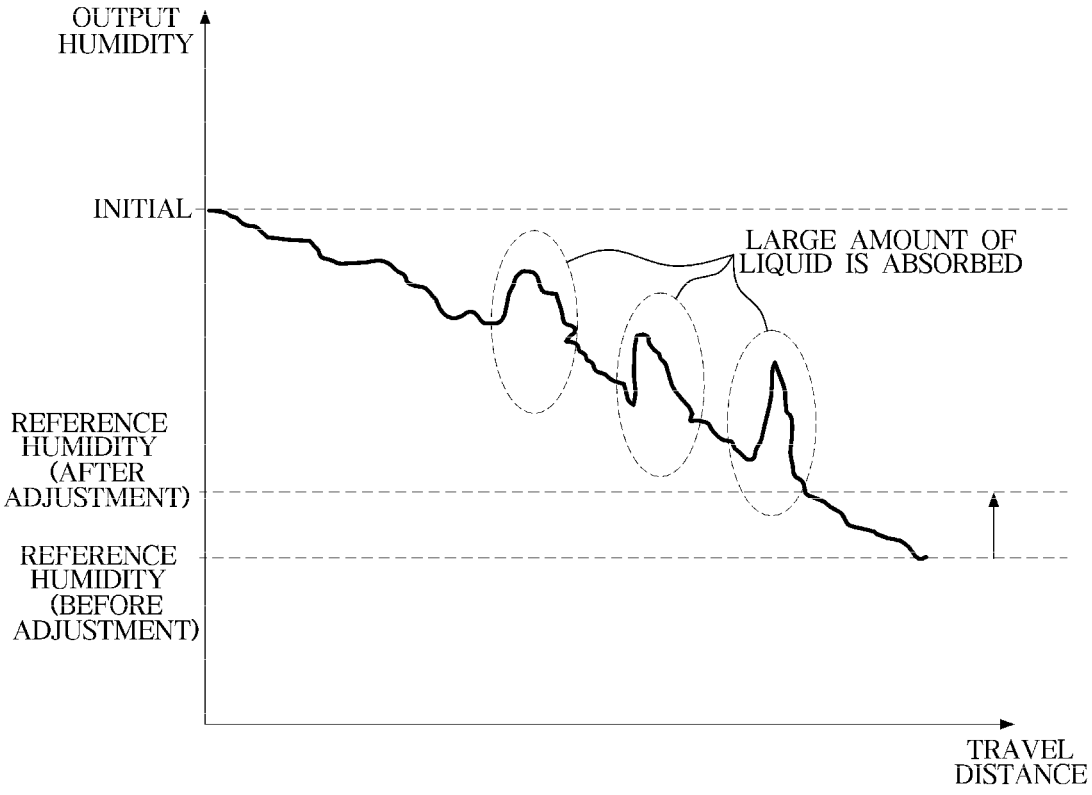

FIGS. 9 and 10 are views for describing a case in which the cleaning robot 10 according to an embodiment of the disclosure adjusts reference humidity.

Referring to FIG. 9, in a case in which the cleaning robot 10 absorbs a large amount of liquid contaminants (for example, 20 ml of coffee) while traveling to perform cleaning, output humidity from the humidity sensor module 110 may increase rapidly.

Also, in a case in which the cleaning robot 10 absorbs a large amount of solid contaminants (for example, 20 g of flour) while traveling to perform cleaning, output humidity from the humidity sensor module 110 may decrease rapidly.

As such, in the case in which the cleaning robot 10 absorbs a large amount of liquid contaminants or a large amount of solid contaminants, a contamination level of the wet cloth pad 16 may increase rapidly, and cleaning by the wet cloth pad 16 may be inefficient.

Accordingly, in a case in which output humidity from the humidity sensor module 110 changes at a preset change rate or more, the cleaning robot 10 according to an embodiment of the disclosure may control the motion driver 150 to immediately return to the docking station.

Also, in the case in which output humidity from the humidity sensor module 110 changes at the preset change rate or more, the cleaning robot 10 according to an embodiment of the disclosure may adjust reference humidity corresponding to a threshold value of cleaning ability degradation for a quick return to the docking station. That is, in the case in which output humidity from the humidity sensor module 110 changes at the preset change rate or more, the controller 140 may adjust the reference humidity to higher humidity. For example, the controller 140 may increase the reference humidity by a predetermined amount (hereinafter an adjustment amoun入).

At this time, according to some embodiments of the disclosure, the cleaning robot 10 may change an adjustment amount of the reference humidity according to a user's setting. That is, the user may adjust control sensitivity for a case in which output humidity from the humidity sensor module 110 changes rapidly through the user interface 120 or the user terminal.

Also, according to some embodiments of the disclosure, in a case in which a number of times by which output humidity from the humidity sensor module 110 changes at the preset change rate or more is greater than or equal to a preset number of times (for example, three times), as shown in FIG. 10, the cleaning robot 10 may adjust the reference humidity to higher humidity. That is, in a case in which a situation in which output humidity from the humidity sensor module 110 changes at the preset change rate or more does not occur by the preset number of times or more, the cleaning robot 10 may identify noise and perform no control of quickly returning to the docking station 20.

Also, according to some embodiments of the disclosure, in a case in which output humidity from the humidity sensor module 110 is maintained at the preset change rate or more for a preset time, the cleaning robot 100 may adjust reference humidity to higher humidity. That is, in a case in which output humidity from the humidity sensor module 110 is not maintained at the preset change rate or more for the preset time, the cleaning robot 10 may identify noise and perform no control of quickly returning to the docking station 20.

Figure 11:
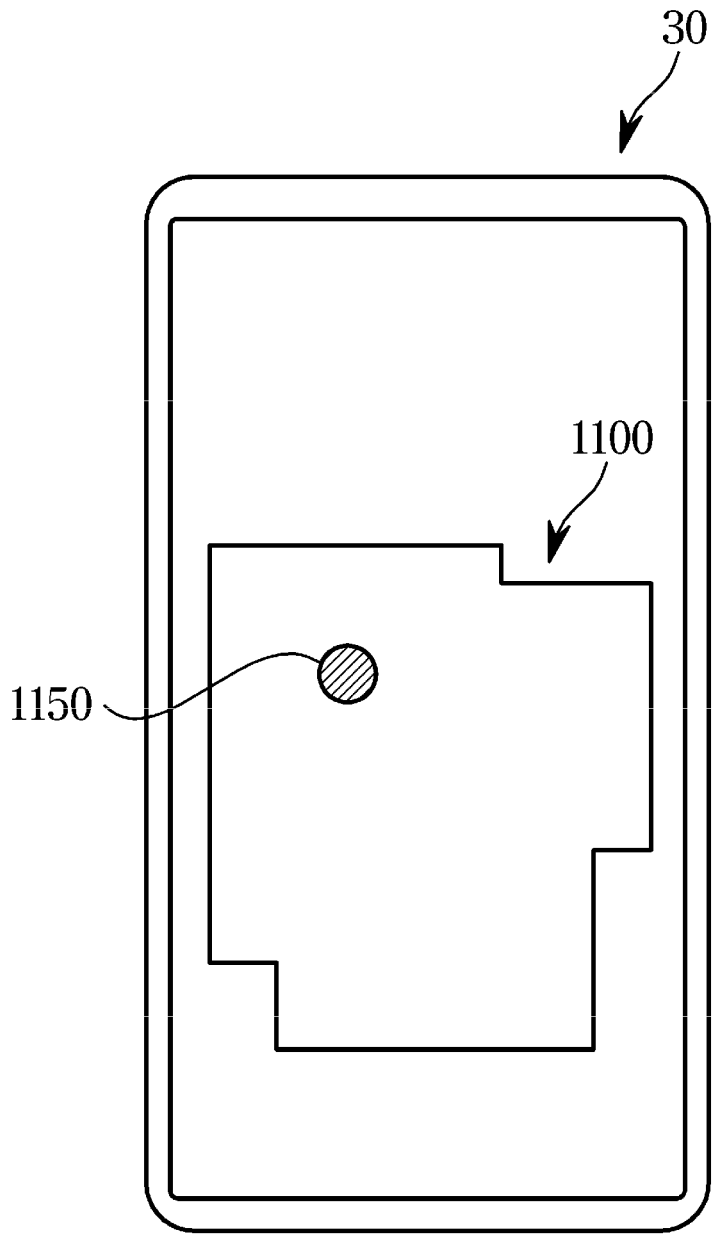
FIG. 11 is a view showing a case in which a cleaning robot according to an embodiment of the disclosure displays an event occurrence zone on a cleaning map according to identification of a contamination pattern.

FIG. 11 is a view showing a case in which the cleaning robot 10 according to an embodiment of the disclosure displays an event occurrence zone on a cleaning map according to identification of a contamination pattern.

Referring to FIG. 11, in a case in which output humidity from the humidity sensor module 110 changes at a preset change rate or more, the cleaning robot 10 according to an embodiment of the disclosure may perform a control of displaying a current location as an event occurrence zone on a cleaning map.

For example, the controller 140 may control the user interface 120 to display the current location as the event occurrence zone on the cleaning map.

Also, the controller 140 may control the communicator 130 to transmit a control command for displaying the current location as the event occurrence zone on the cleaning map to the user terminal 30. In this case, the user terminal 30 may display an event occurrence zone 1150 on a cleaning map 1100, as shown in FIG. 11.

In the case in which output humidity from the humidity sensor module 110 changes at the preset change rate or more, the controller 140 according to an embodiment of the disclosure may set the current location to a cleaning prohibited zone. At this time, according to some embodiments of the disclosure, the controller 140 may adjust a radius of the cleaning prohibited zone according to a user's setting. For example, the controller 140 may adjust a radius of the cleaning prohibited zone based on a user input received from the user interface 120 or input by the user terminal and received through the communicator 130.

Figure 12:
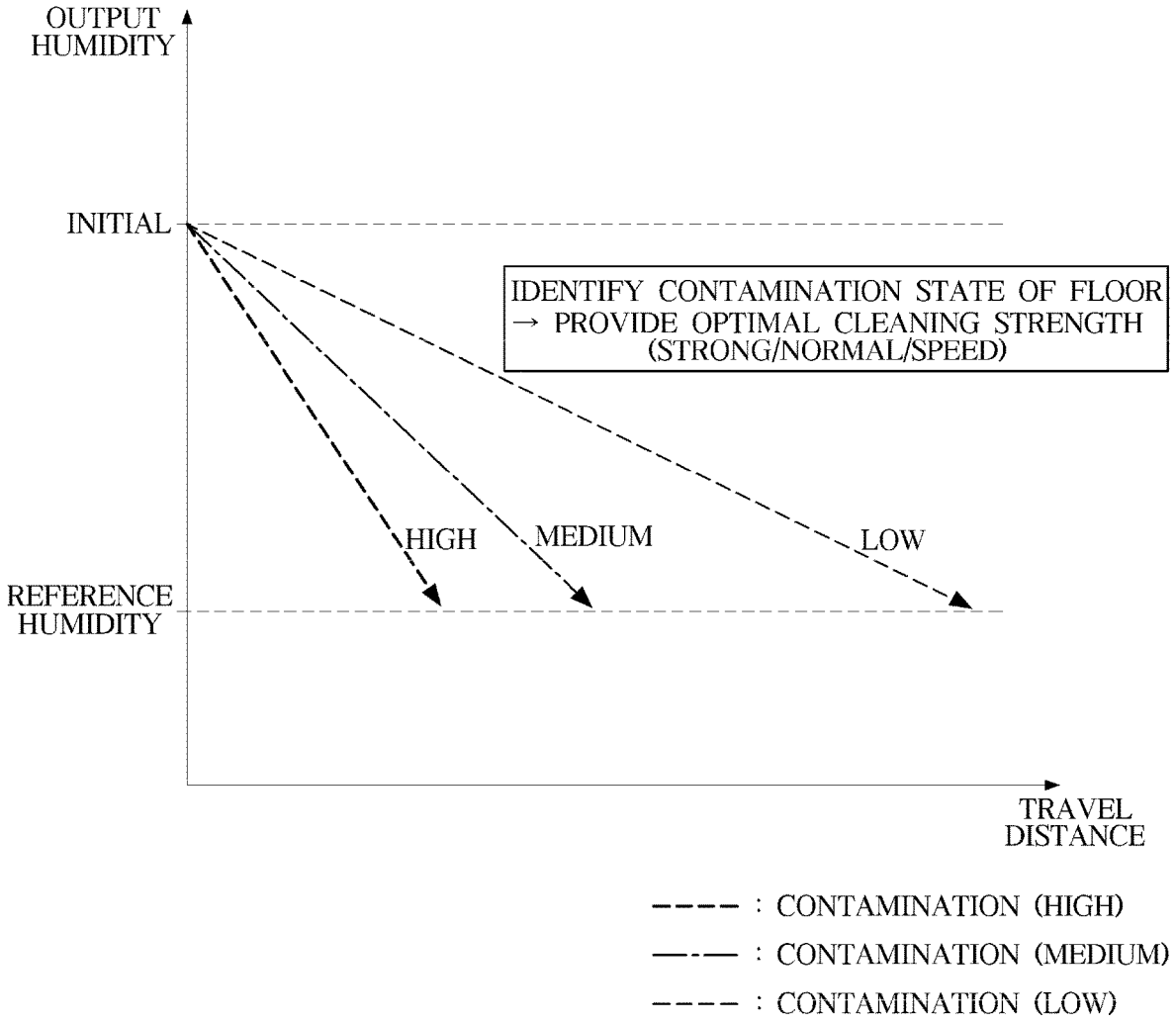
FIG. 12 is a view for describing a case in which a cleaning robot according to an embodiment of the disclosure controls a cleaning strength based on output humidity.

FIG. 12 is a view for describing a case in which the cleaning robot 10 according to an embodiment of the disclosure controls a cleaning strength based on output humidity.

Referring to FIG. 12, the cleaning robot 10 according to an embodiment of the disclosure may control the pad motor 160 to adjust a rotation speed of the wet cloth pad 16 based on output humidity from the humidity sensor module 110.

More specifically, according to some embodiments of the disclosure, the cleaning robot 10 may control the pad motor 160 to increase a rotation speed of the wet cloth pad 16 in proportion to a change rate of output humidity from the humidity sensor module 110 according to traveling.

For example, while the cleaning robot 10 travels to perform cleaning, a contamination level of the wet cloth pad 16 may increase, a water content of the wet cloth pad 16 may decrease, and output humidity from the humidity sensor module 110 may decrease.

At this time, as shown in FIG. 12, the higher contamination level of the floor, the greater change amount of a water content of the wet cloth pad 16, resulting in an increase of a change rate (a change slope) of output humidity from the humidity sensor module 110.

The cleaning robot 10 may adjust a cleaning strength adaptively according to a contamination level of the floor, by increasing a rotation speed of the wet cloth pad 16 at a greater change rate of output humidity from the humidity sensor module 110 to raise a cleaning strength with respect to the floor.

For example, the cleaning robot 10 may classify cleaning strengths into three levels (for example, strong, normal, and speed), and change a cleaning strength adaptively according to a change rate of output humidity from the humidity sensor module 110.

So far, an operation for adjusting a cleaning strength or controlling a return to the docking station 20 based on output humidity from the humidity sensor module 110 has been described. However, according to some embodiments of the disclosure, the cleaning robot 10 according to the disclosure may use, as a control factor, a cumulative integral value with respect to a change of output humidity from the humidity sensor module 110, instead of using output humidity from the humidity sensor module 110 as a control factor.

Hereinafter, an embodiment for a method for controlling the cleaning robot 10, according to an aspect, will be described. In the method for controlling the cleaning robot 10, the cleaning robot 10 according to the above-described embodiment of the disclosure may be used. Accordingly, content described above with reference to FIGS. 1 to 12 may be applied in the same way to the method for controlling the cleaning robot 10.

Figure 13:
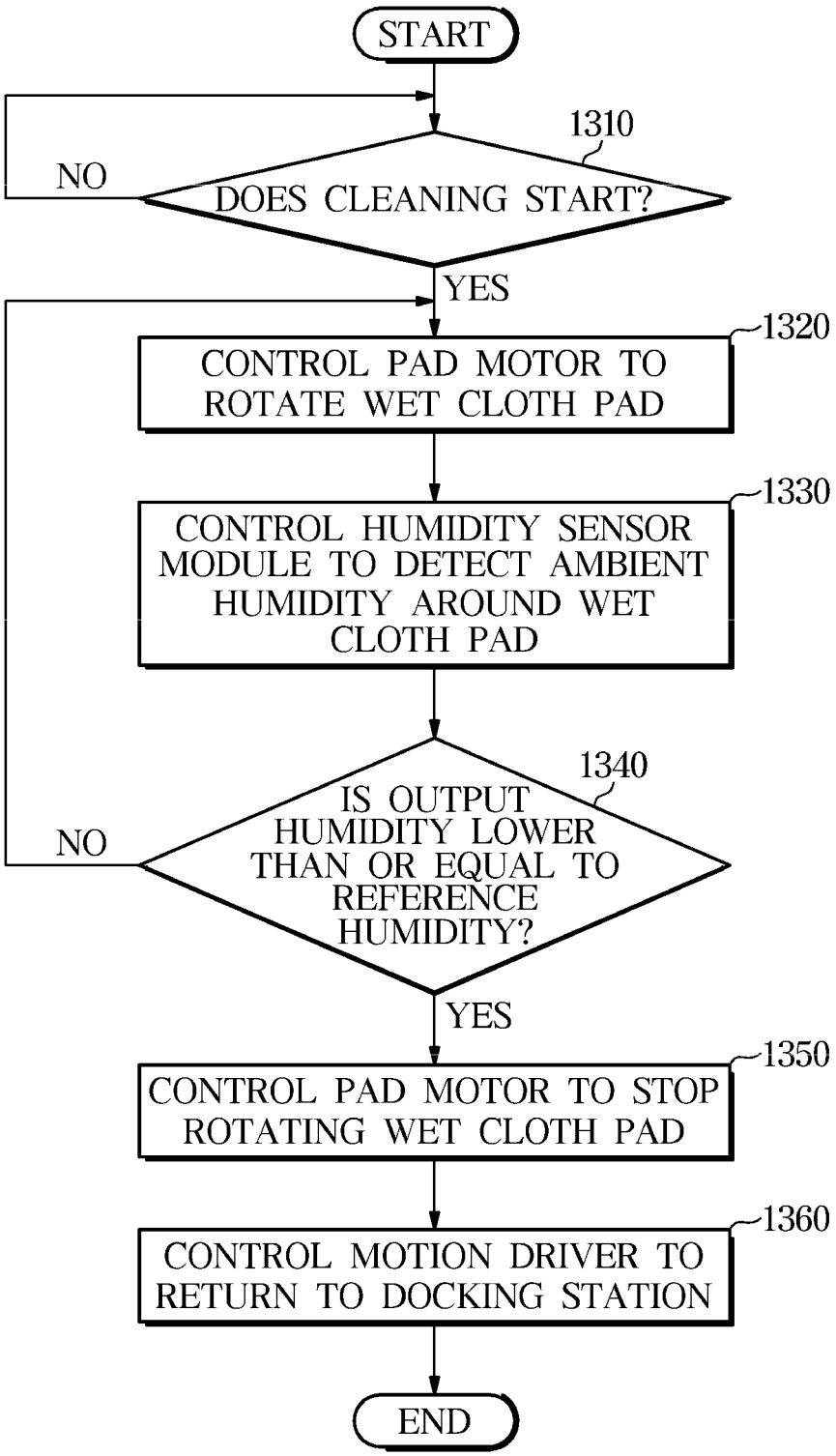
FIG. 13 is a flowchart showing a case of controlling a return to a docking station based on output humidity from a humidity sensor module in a method for controlling a cleaning robot according to an embodiment of the disclosure.

FIG. 13 is a flowchart showing a case of controlling a return to the docking station 20 based on output humidity from the humidity sensor module 110 in a method for controlling the cleaning robot 10 according to an embodiment of the disclosure.

Referring to FIG. 13, according to a start of cleaning (YES in operation 1310), the cleaning robot 10 according to an embodiment of the disclosure may control the pad motor 160 to rotate the wet cloth pad 16 (operation 1320) and control the humidity sensor module 110 to detect ambient humidity around the wet cloth pad 16 (operation 1330).

In a case in which output humidity is lower than or equal to reference humidity (YES in operation 1340), the cleaning robot 10 according to an embodiment of the disclosure may control the pad motor 160 to stop rotating the wet cloth pad 16 (operation 1350) and control the motion driver 150 to return to the docking station 20 (operation 1360).

That is, the cleaning robot 10 may identify a return to the docking station 20 by comparing output humidity from the humidity sensor module 110 with the reference humidity corresponding to a threshold value of cleaning ability degradation, thereby preventing a case in which the floor is contaminated while the wet cloth pad 16 performs cleaning, guiding replacement or washing of the wet cloth pad 16 for a user, or causing the wet cloth pad 16 to be automatically replaced or washed in the docking station 20.

Figure 14:
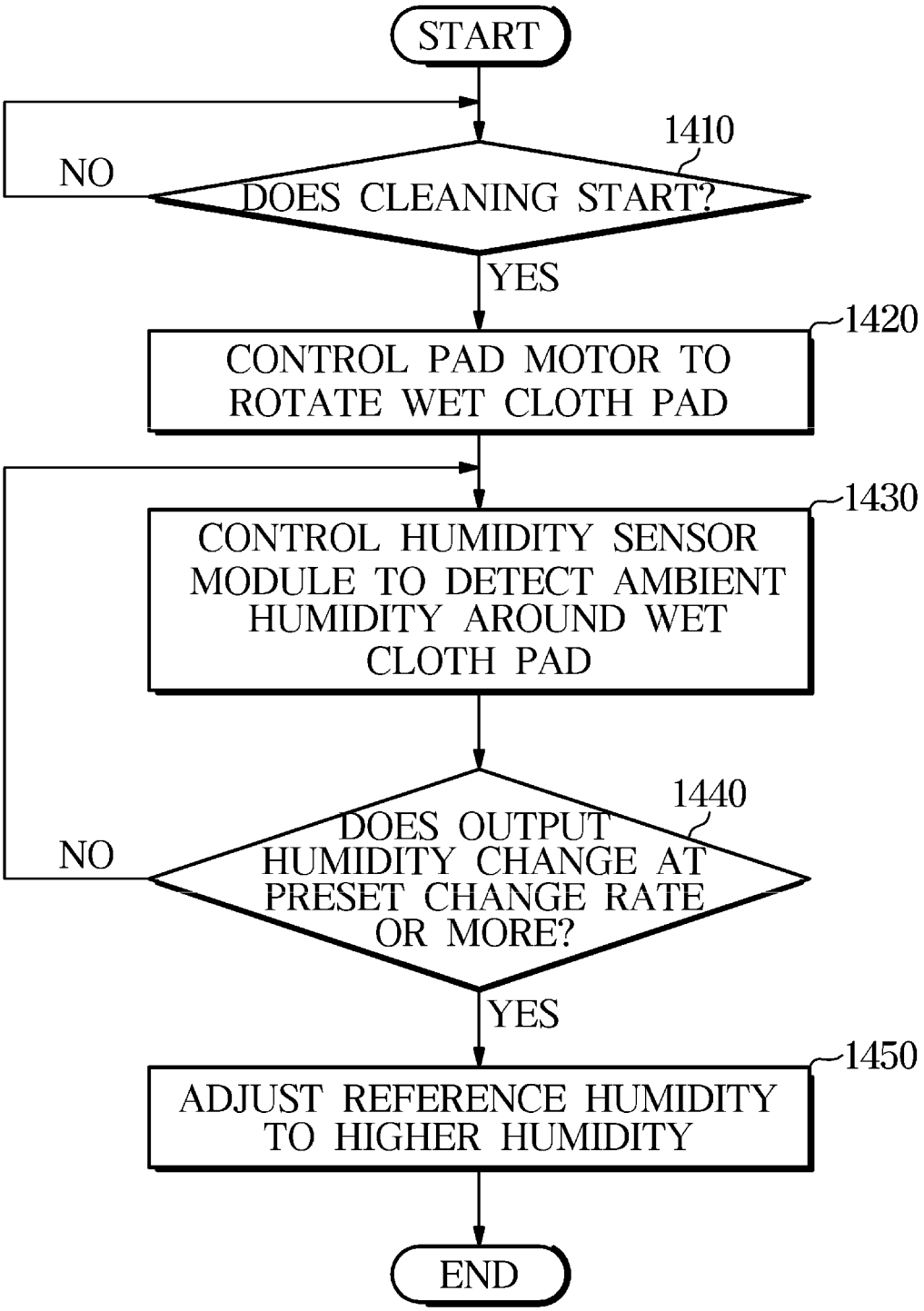
FIG. 14 is a flowchart showing a case of adjusting reference humidity for a return to a docking station in a method for controlling a cleaning robot according to an embodiment of the disclosure.

FIG. 14 is a flowchart showing a case of adjusting reference humidity for a return to the docking station 20 in a method for controlling the cleaning robot 10 according to an embodiment of the disclosure.

Referring to FIG. 14, according to a start of cleaning (YES in operation 1410), the cleaning robot 10 according to an embodiment of the disclosure may control the pad motor 160 to rotate the wet cloth pad 16 (operation 1420) and control the humidity sensor module 110 to detect ambient humidity around the wet cloth pad 16 (operation 1430).

In a case in which output humidity changes at a preset change rate or more (YES in operation 1440), the cleaning robot 10 according to an embodiment of the disclosure may adjust reference humidity to higher humidity (operation 1450).

In a case in which the cleaning robot 10 absorbs a large amount of liquid contaminants or a large amount of solid contaminants, a contamination level of the wet cloth pad 16 may increase rapidly, and cleaning by the wet cloth pad 16 may be inefficient. Accordingly, in a case in which the cleaning robot 10 detects a rapid change of output humidity from the humidity sensor module 110, caused by absorption of a large amount of liquid or solid contaminations, the cleaning robot 10 may adjust the reference humidity to higher humidity for a quick return to the docking station 20.

Figure 15:
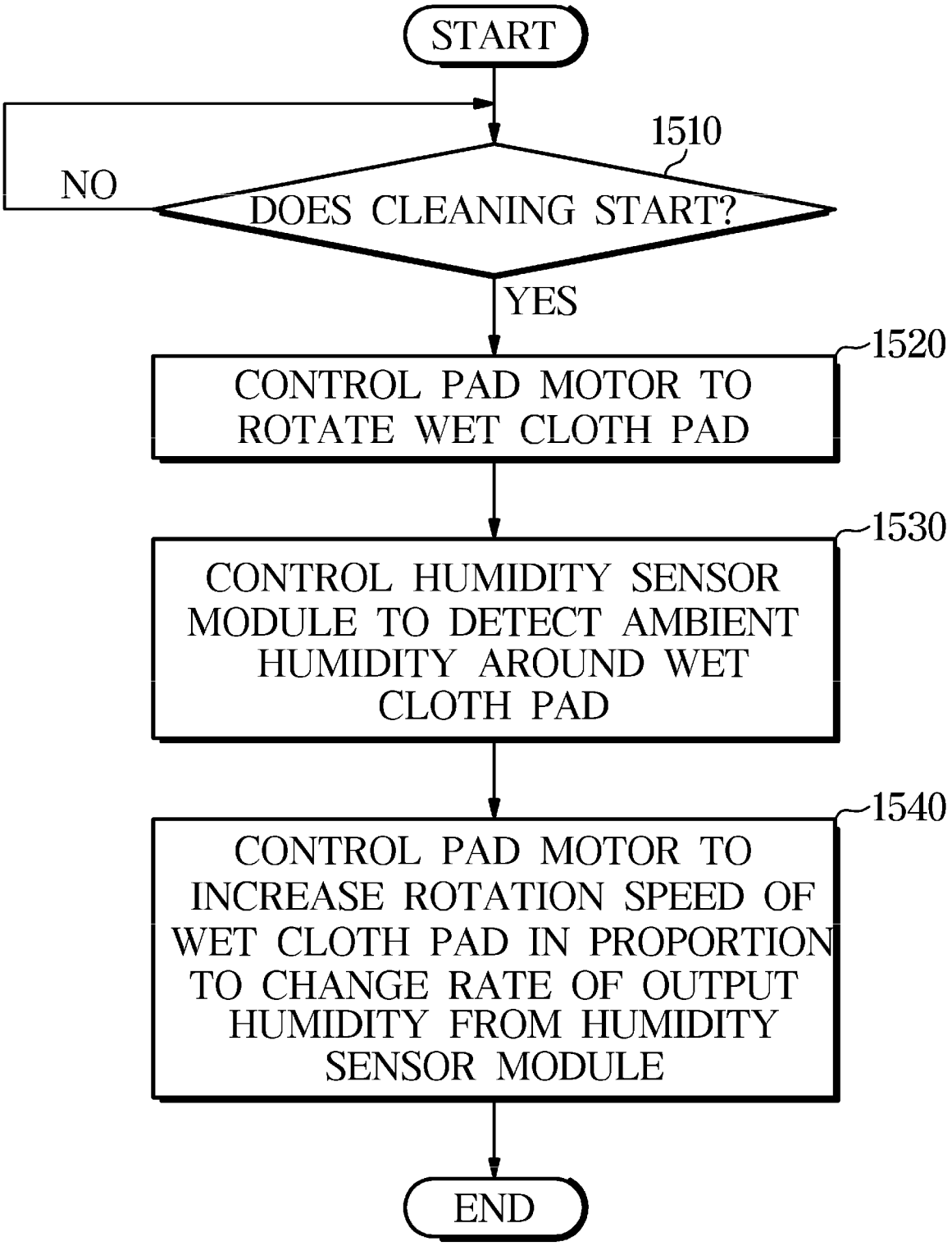
FIG. 15 is a flowchart showing a case of controlling a rotation speed of a pad motor based on output humidity from a humidity sensor module in a method for controlling a cleaning robot according to an embodiment of the disclosure.

FIG. 15 is a flowchart showing a case of controlling a rotation speed of the pad motor 160 based on output humidity from the humidity sensor module 110 in a method for controlling the cleaning robot 10 according to an embodiment of the disclosure.

Referring to FIG. 15, according to a start of cleaning (YES in operation 1510), the cleaning robot 10 according to an embodiment of the disclosure may control the pad motor 160 to rotate the wet cloth pad 16 (operation 1520), and control the humidity sensor module 110 to detect ambient humidity around the wet cloth pad 16 (operation 1530).

The cleaning robot 10 according to an embodiment of the disclosure may control the pad motor 160 to increase a rotation speed of the wet cloth pad 16 in proportion to a change rate of output humidity from the humidity sensor module 110 (operation 1540).

That is, the cleaning robot 10 may adjust a cleaning strength adaptively according to a contamination level of the floor, by increasing a rotation speed of the wet cloth pad 16 at a greater change rate of output humidity from the humidity sensor module 110 to raise a cleaning strength with respect to the floor.

For example, the cleaning robot 10 may classify cleaning strengths into three levels (for example, strong, normal, and speed), and change a cleaning strength adaptively according to a change rate (a change slope) level of output humidity from the humidity sensor module 110.

Meanwhile, the disclosed embodiments may be implemented in the form of a recording medium that stores instructions executable by a computer. The instructions may be stored in the form of a program code, and when executed by a processor, the instructions may create a program module to perform operations of the disclosed embodiments. The recording medium may be implemented as a computer-readable recording medium.

The computer-readable recording medium may include all kinds of recording media storing instructions that can be interpreted by a computer. For example, the recording media may include Read Only Memory (ROM), Random Access Memory (RAM), a magnetic tape, a magnetic disc, flash memory, an optical data storage device, etc.

So far, the disclosed embodiments have been described with reference to the accompanying drawings. It will be understood by one of ordinary skill in the technical art to which the disclosure belongs that the disclosure can be embodied in different forms from the disclosed embodiments without changing the technical spirit and essential features of the present disclosure. Thus, it should be understood that the disclosed embodiments described above are merely for illustrative purposes and not for limitation purposes.

What is claimed is:

1. A cleaning robot comprising:

a main body;

a motion driver provided in the main body, and the motion driver configured to move the cleaning robot;

a pad motor provided in the main body, the pad motor configured to rotate a pad provided on a lower surface of the main body;

a humidity sensor provided around the pad and configured to detect humidity around the pad;

a user interface configured to receive a user input;

a communicator configured to communicate with a user terminal; and a controller configured to control an operation of the pad motor and an operation of the motion driver, wherein the controller configured to:

set a reference humidity based on the user input received from the user interface or the user terminal;

based on the detected humidity being lower than the reference humidity while the motion driver and the pad motor are operating, control the pad motor to stop rotating of the pad and control the motion driver to return the cleaning robot to a docking station.

2. The cleaning robot of claim 1, wherein, while the cleaning robot is returning to the docking station based on the detected humidity being lower than the reference humidity, the at controller is configured to control the user interface to guide washing of the pad or to guide a replacement of wet cloth for a user.

3. The cleaning robot of claim 1, wherein, while the cleaning robot is returning to the docking station based on the detected humidity being lower than the reference humidity, the controller is configured to control the pad to be spaced apart from a floor so that the pad does not contact the floor.

4. The cleaning robot of claim 1, wherein, in response to determining that the detected current humidity is changed at a preset change rate or more, the controller is configured to increase the reference humidity by a predetermined amount.

5. The cleaning robot of claim 4, wherein, in response to determining that a number of times by which the detected humidity changes at the preset change rate or more is a preset number of times or more, the controller is configured to increase the reference humidity by the predetermined amount.

6. The cleaning robot of claim 4, wherein, in response to determining that the detected humidity is maintained at the preset change rate or more for a preset time, the controller is configured to increase the reference humidity by a predetermined amount.

7. The cleaning robot of claim 4, wherein the at controller is configured to change the predetermined amount according to a user's setting.

8. The cleaning robot of claim 1, wherein the controller is configured to control the pad motor to adjust a rotation speed of the pad based on the detected humidity.

9. The cleaning robot of claim 8, wherein the at controller is configured to control the pad motor to increase a rotation speed of the pad in proportion to a change rate of the detected humidity according to a traveling of the cleaning robot.

10. The cleaning robot of claim 1, wherein, in response to determining that the detected humidity changes at a preset change rate or more, the controller is configured to control the pad motor to change a rotation speed of the pad.

11. The cleaning robot of claim 1, wherein, in response to determining that the detected humidity changes at a preset change rate or more, the controller is configured to control to display a current location as an event occurrence zone on a cleaning map.

12. The cleaning robot of claim 1, wherein, in response to determining that the detected humidity changes at a preset change rate or more, the controller is configured to set a current location to a cleaning prohibited zone.

13. The cleaning robot of claim 12, wherein the at controller is configured to adjust a radius of the cleaning prohibited zone according to a user's setting.

14. A method for controlling a cleaning robot including a main body, a motion driver provided in the main body and configured to move the cleaning robot, and a pad motor provided in the main body and configured to rotate a pad provided on a lower surface of the main body, a humidity sensor provided around the pad and configured to detect humidity around the pad; a user interface configured to receive a user input, a communicator configure to communicate with a user terminal, and a controller, the method comprising:

setting, by the controller, a reference humidity based on the user input received from the user interface or the user terminal;

based on the detected humidity, being lower than the reference humidity while the motion driver and the pad motor are operating;

controlling, by the controller, the pad motor to stop rotating of the pad; and controlling, by the controller, the motion driver to return the cleaning robot to a docking station.

15. The method of claim 14, further comprising in response to determining that the detected humidity changes at a preset change rate or more, increasing the reference humidity by a predetermined amount.

* * * * *